US007152835B1

(12) United States Patent
Riblet

(10) Patent No.: US 7,152,835 B1
(45) Date of Patent: Dec. 26, 2006

(54) BRACKET ASSEMBLY LOCK

(76) Inventor: Henry J. Riblet, 93 Pine Needle La., Melvin Village, NH (US) 03850

( * ) Notice: Subject to any disclaimer, the term of this patent is extended or adjusted under 35 U.S.C. 154(b) by 0 days.

(21) Appl. No.: 09/955,467

(22) Filed: Sep. 17, 2001

Related U.S. Application Data

(63) Continuation-in-part of application No. 09/477,660, filed on Jan. 5, 2000, now abandoned.

(51) Int. Cl.
*E04B 7/28* (2006.01)

(52) U.S. Cl. ..... 248/246; 248/248; 248/235

(58) Field of Classification Search ..... 248/246, 248/248, 219.4, 240, 247, 235, 240.3, 300; 211/135, 193; 182/128, 136, 146, 148
See application file for complete search history.

(56) References Cited

U.S. PATENT DOCUMENTS

| | | | | | |
|---|---|---|---|---|---|
| 878,455 | A | | 2/1908 | Carter | |
| 890,804 | A | | 6/1908 | Shears | |
| 1,416,296 | A | * | 5/1922 | Hoitsma | 182/136 |
| 1,832,394 | A | * | 11/1931 | Holmboe | 254/104 |
| 2,216,912 | A | * | 10/1940 | Hoitsma | 182/136 |
| 2,244,374 | A | | 6/1941 | Riblet | |
| 2,342,427 | A | | 2/1944 | Riblet | |
| 2,727,712 | A | | 12/1955 | Holmboe | |
| 2,737,363 | A | * | 3/1956 | Horst | 248/354.1 |
| 2,854,293 | A | | 9/1958 | Riblet | |
| 2,891,759 | A | | 6/1959 | Holmboe, Sr. | |
| 3,065,984 | A | * | 11/1962 | Holmboe | 403/393 |
| 3,473,774 | A | | 10/1969 | Riblet | |
| 3,970,277 | A | | 7/1976 | Riblet | |
| 4,103,856 | A | * | 8/1978 | Riblet | 182/133 |
| 4,308,934 | A | * | 1/1982 | Jackson et al. | 182/182.4 |
| 4,463,828 | A | | 8/1984 | Anderson | |
| 4,597,471 | A | | 7/1986 | Anderson | |
| 5,257,766 | A | | 11/1993 | Riblet | |
| 5,342,031 | A | * | 8/1994 | Yu-Fang | 269/134 |
| 5,941,486 | A | * | 8/1999 | Riblet | 248/219.4 |
| 6,126,127 | A | | 10/2000 | Riblet | |
| 6,273,381 | B1 | * | 8/2001 | Riblet | 248/235 |
| 6,419,201 | B1 | * | 7/2002 | Hughes et al. | 248/514 |
| 2002/0179371 | A1 | * | 12/2002 | Riblet | 182/136 |

* cited by examiner

*Primary Examiner*—Anita M. King
(74) *Attorney, Agent, or Firm*—Bourque & Associates, P.A.

(57) ABSTRACT

A bracket assembly includes an angle bracket having a horizontal leg and a vertical leg. A lower bracket arm and a lock are coupled to the angle bracket and cooperate to mount the angle bracket onto an upright. The lock includes a pair of side members pivotally coupled to the angle bracket by a fulcrum bar. The pair of side members include a first pair of openings for an outer jaw and a second pair of openings for an inner jaw, the second pair of openings being disposed, in the case of a load activated lock, beneath the plane defined by the fulcrum bar and the first pair of openings. In one embodiment, inner jaw comprises a contact surface which is flat. In another embodiment, the inner jaw comprises a contact surface which includes a plurality of rasps.

9 Claims, 9 Drawing Sheets

BRACKET ASSEMBLY LOCK

CROSS-REFERENCE TO RELATED APPLICATIONS

The present application is a continuation-in-part of U.S. patent application Ser. No. 09/477,660, inventor Henry J. Riblet, filed Jan. 5, 2000, now abandoned the disclosure of which is incorporated herein by reference.

BACKGROUND OF THE INVENTION

The present invention relates generally to scaffold bracket assemblies and more particularly, to the jaws of locks for the bracket assemblies of adjustable height scaffolds which mount on aluminum or fiberglass uprights.

Adjustable height scaffolds are well known in the art and typically comprise four main elements: an upright, a bracket assembly for supporting a work platform on the upright, a jack or block and tackle for raising and lowering the bracket assembly on the upright, and an upright cage for holding the upper end of the upright in place.

Two types of adjustable height scaffolds which are designed for uprights constructed of wood or rubber-backed aluminum are well known and widely used in the art.

An example of an adjustable height scaffold which is designed for use with an upright constructed of wood is U.S. Pat. No. 2,216,912 to Hoitsma. The Hoitsma patent discloses an angle bracket to which a jack is coupled, this type of bracket assembly being commonly referred to simply as a pump jack in the art. Another example of an adjustable height scaffold which is designed for use with an upright constructed of wood is U.S. Pat. No. 2,342,427 to Riblet. The Riblet '427 patent discloses a bracket assembly which is raised and lowered by a block and tackle, this type of bracket assembly being commonly referred to simply as a Painter's Pole in the art.

Examples of adjustable height scaffolds which are designed for use with an upright constructed of rubber backed aluminum include U.S. Pat. No. 4,597,471 to Anderson and U.S. Pat. No. 5,259,478 to Berish et al. It should be noted that the Anderson patent and the Berish patent both adapt aspects of the pump jack mechanism disclosed in the Hoitsma patent noted above. It should also be noted that aspects of the Painter's Pole mechanism disclosed in Riblet '427 for adjustable height scaffolds have been adapted for use on rubber-backed aluminum uprights.

U.S. Pat. No. 2,801,851 to Meek and U.S. Pat. No. 2,891,759 to Holmboe disclose related bracket assemblies. The bracket assemblies disclosed in Meek and Holmboe differ from the bracket assemblies noted above in that the bracket assemblies disclosed in Meek and Holmboe include an inner jaw which is formed from an extended surface of its associated angle bracket. It should be noted that the bracket assemblies disclosed in Meek and Holmboe were not intended for use in adjustable height scaffolds. Accordingly, it is not clear how reliably the lock of Meek and/or Holmboe would grip an upright if utilized for the height adjustment of a scaffold.

The load supporting lock of the pump jack is pivotally connected to a pair of linkage members which, in turn, are pivotally connected to the angle bracket of the adjustable height scaffold. In contrast, the load supporting lock of the Painter's Pole is directly connected by a pivot bar to the angle bracket.

As can be appreciated, the implementation of a linkage in the pump jack is significant in that the load placed on the angle bracket is not transferred directly to the lock. As a result, a spring is required to initiate contact of the jaws of the lock with the upright. To the contrary, in the Painter's Pole, the lock is directly coupled to the angle bracket so that a load placed on the angle bracket always exerts a turning moment on the lock, such a lock being commonly referred to as a load actuated lock in the art.

A load actuated lock, by definition, is pivotally coupled directly to the angle bracket. Furthermore, in the Painter's Pole, the lock is pivotally coupled to the angle bracket in such a manner so that the application of a turning moment onto the lock brings both jaws of the lock into contact with the upright when the width of the upright exceeds the desired design width, thereby activating the lock. Accordingly, a load actuated lock which functions in this manner is often referred to simply as a load activated lock.

It should be noted that, upon the placement of a load onto the angle bracket of a pump jack, crossbars at the upper and lower ends of the angle bracket exert horizontal forces onto the upright. By contrast, upon the placement of a load onto the angle bracket of a Painter's Pole, the horizontal force on the load actuated lock created by the offset load is directly applied onto the upright. As such, the horizontal forces exerted on an upright by the jaws of the Painter's Pole load actuated lock are substantially greater than the horizontal forces exerted on an upright by the jaws of the pump jack, spring activated lock. As a result, in order to obtain the same load supporting vertical force as the Painter's Pole, the jaws of the pump jack lock require a greater coefficient of friction with the surface of the upright.

Consequently, it is well known in the art for the outer jaw of commercial pump jacks to include a sharpened edge to increase the coefficient of friction between the outer jaw and the surface of an upright. In contrast, the jaws of the lock of a Painter's Pole comprise smooth, cylindrical surfaces which contact the surface of a wooden upright along the points of a cylinder. As a result of its sharpened edge, the jaw of a pump jack lock requires less horizontal force than the rounded edged jaws of Painter's Pole locks in order to provide the same vertical, frictional force on a wooden upright.

When used on metal uprights, such as aluminum uprights, pump jack locks and Painter's Pole locks typically retain the similar types of jaws. Specifically, when used on metal uprights, pump jack locks comprise a sharpened edged outer jaw and a rounded edged inner jaw whereas Painter's Pole locks comprise rounded edged inner and outer jaws. Both types of jaws are referred to as "edged" jaws because both contact a flat faced aluminum upright along a line.

It should be noted that the edged outer jaw of a pump jack lock and the edged jaws of a Painter's Pole lock introduces a significant drawback. Specifically, it has been found that the edged outer jaw of a pump jack lock as well as the edged jaws of the Painter's Pole lock tend to gall or mar a metal upright, which is highly undesirable.

Accordingly, in order to minimize the galling or marring of an aluminum upright by the edged jaws of a pump jack lock or the edged jaws of a Painter's Pole lock, aluminum uprights are backed with a strip of rubber.

However, it has been found that backing an aluminum upright with a strip of rubber introduces notable drawbacks. Specifically, backing an aluminum upright with a strip of rubber significantly increases both the weight and the cost of the upright without adding to the strength of the upright. In addition, backing an aluminum upright with a strip of rubber introduces as a key factor, in the level of safety of the lock on the upright, the reliability of the rubber backing.

SUMMARY OF THE INVENTION

It is an object of the present invention to provide a new and improved lock for a bracket assembly.

It is another object of the present invention to provide a lock for a bracket assembly of the type described above which securely retains the bracket assembly mounted on a metal or plastic vertical upright having a smooth and/or hard outer surface.

It is still another object of the present invention to provide a lock for a bracket assembly of the type described above which is strong and which is constructed to withstand heavy loads.

It is another object of the present invention to provide a lock for a bracket assembly of the type described above which distributes horizontal forces over a sufficient area of the upright so that the surface of the upright is not degraded in normal use.

Accordingly, in one embodiment of the present invention, there is provided a lock for mounting an angle bracket on an upright, said lock comprising a pair of side members, an outer jaw and an inner jaw coupled to said pair of side members, a fulcrum bar which is adapted to couple said pair of side members to said angle bracket, said pair of side members being able to pivot relative to said angle bracket about said fulcrum bar, at least one of said inner jaw and said outer jaw comprising a contact surface which is adapted to contact the upright over an planar region, said at least one of said inner jaw and said outer jaw being capable of pivoting relative to said pair of side members and said angle bracket.

In another embodiment of the present invention, there is provided a lock for mounting an angle bracket on an upright, said upright having a plurality of surface irregularities, said lock comprising a pair of side members, an outer jaw and an inner jaw coupled to said pair of side members, a fulcrum bar which is adapted to couple said pair of side members to said angle bracket, said pair of side members being capable of pivoting relative to said angle bracket about said fulcrum bar, at least one of said inner jaw and said outer jaw comprising a contact surface that includes a plurality of surface irregularities, the plurality of surface irregularities on at least one of said inner jaw and said outer jaw being sized and shaped to matingly engage with the plurality of surface irregularities on said upright, said at least one of said inner jaw and said outer jaw being capable of pivoting relative to said pair of side members and said angle bracket.

It should be emphasized that independent pivoting of the side members with respect to the angle bracket and at least one of said inner and outer jaws is determined by the requirement that at least one of said jaws contact the upright over a wide area in spite of variations in the relationship between said angle bracket and said upright. The means, which accomplish the independent pivoting of the side members with respect to the angle bracket and the at least one of said jaws, is not a principle feature of the present invention.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF A PREFERRED EMBODIMENT

Figure 1A:
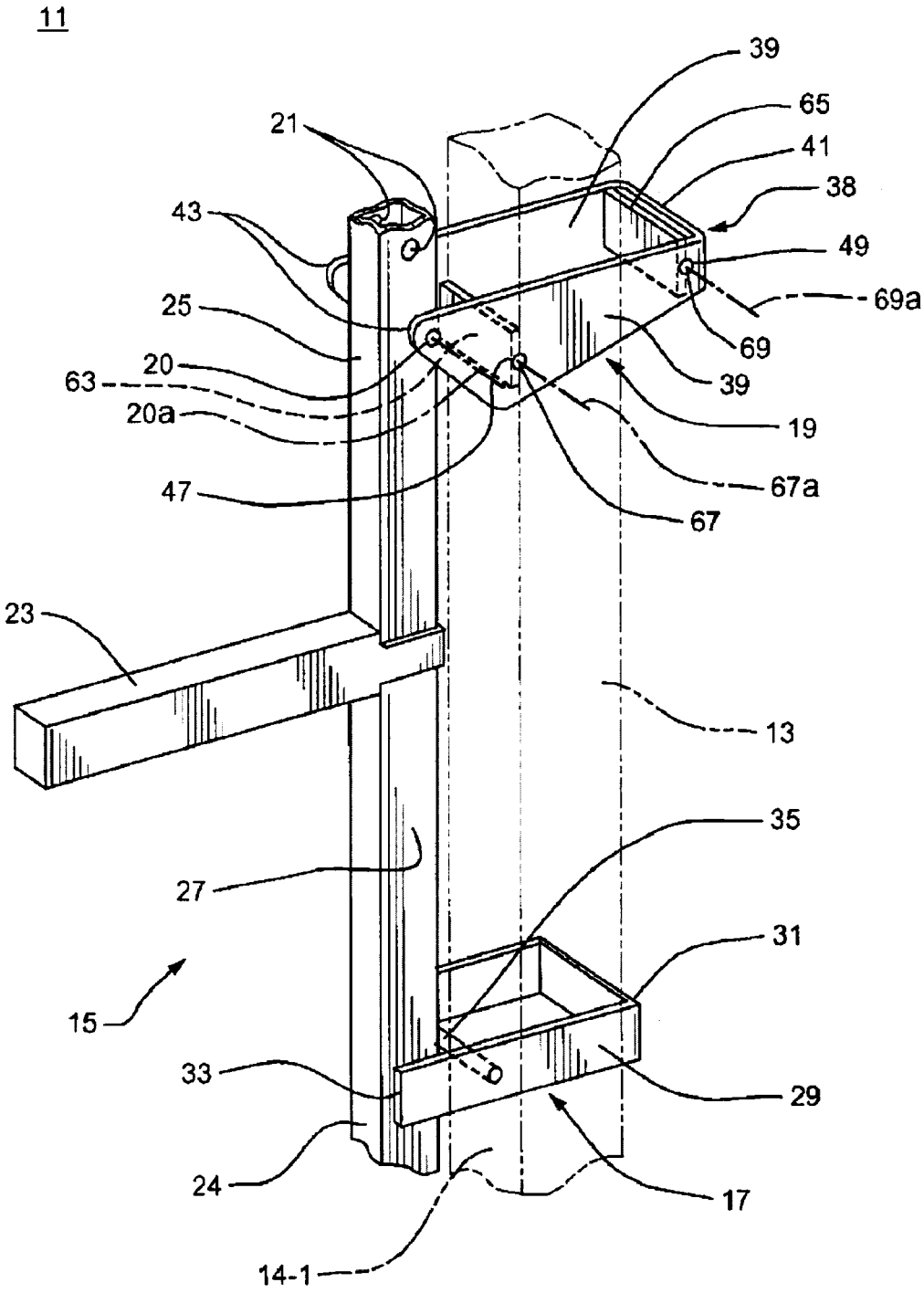
FIG. 1*a* is a perspective view of an embodiment of a bracket assembly constructed according to the teachings of the present invention, the bracket assembly being shown mounted on a vertical upright of design width shown in phantom.

Referring now to FIG. 1*a*, there is shown a perspective view of an embodiment of a bracket assembly constructed according to the teachings of the present invention, the bracket assembly being represented generally by reference numeral 11. Bracket assembly 11 is shown mounted on an upright 13 of design width, upright 13 representing an object, such as a beam or a pole, which is constructed of any suitable hard material, such as aluminum or plastic.

Bracket assembly 11 comprises an angle bracket 15, a lower bracket arm 17 and a load activated lock 19, load activated lock 19 including a fulcrum bar 20 for pivotally attaching lock 19 to angle bracket 15.

Bracket arm 17 and load activated lock 19 cooperate to mount angle bracket 15 onto upright 13. In this manner, a pair of bracket assemblies 11 can be used to create a scaffold. Specifically, with each of the pair of bracket assemblies mounted onto an associated upright, a scaffold is created by placing a plank across each angle bracket of the pair of bracket assemblies.

Angle bracket 15 comprises a horizontal leg 23 and a vertical leg 27.

It is to be understood that angle bracket 15 does not serve as a principle feature of the present invention. Accordingly, angle bracket 15 could be replaced with alternative types of angle brackets without departing from the spirit of the present invention. As an example, angle bracket 15 could be modified in such a manner so that the outer end of horizontal leg 23 and the lower end of vertical leg 27 are reinforced by a diagonal leg. As another example, angle bracket 15 could be replaced with the substantially triangular bracket shown in U.S. Pat. No. 6,126,127 to Riblet.

Lower bracket arm 17 comprises a U-shaped band 29 having a closed end 31 and an open end 33. Lower bracket arm 17 is coupled to angle bracket 15 by welding open end 33 of band 29 onto lower end 24 of vertical leg 27. Positioned as such, the placement of a vertical load on horizontal leg 23 of angle bracket 15 will force cross bar 35 against inner surface 14-1 of upright 13.

It is to be understood that the particular construction of lower bracket arm 17 is not a principal feature of the present invention. Accordingly, lower bracket arm 17 could be replaced with alternative types of bracket arms without departing from the spirit of the present invention.

Vertical leg 27 includes a pair of apertures 21. As can be appreciated, a conventional block and tackle device (not shown) or a conventional jacking device (not shown) can be attached to angle bracket 11 through apertures 21 to enable angle bracket 11 to be raised and lowered.

Load activated lock 19 comprises a generally U-shaped band 38 having a pair of spaced apart, parallel side members 39, a closed end 41 and a pair of free ends 43. Side members 39 of U-shaped band 38 are coupled to angle bracket 15 at upper end 25 of vertical leg 27 by generally cylindrical fulcrum bar 20. Specifically, fulcrum bar 20 extends through side members 39 and vertical leg 27 and provides a fixed pivoting axis 20*a* about which load activated lock 19 is free to pivot relative to angle bracket 15.

It should be noted that fulcrum bar 20 represents any conventional device for pivotally mounting load activated lock 19 onto angle bracket 15. Preferably, fulcrum bar 20 is in the form of a continuous rod which is held in place by a pair of nuts. However, it is to be understood that the particular construction of fulcrum bar 20 does not serve as a principle feature of the present invention. Accordingly, fulcrum bar 20 could be replaced with any device which attaches lock 19 directly to angle bracket 15 and still permits lock 19 to pivot with respect to angle bracket 15 about fulcrum pivot axis 20*a*.

It should be noted that load activated lock 19 is not limited to comprising a generally U-shaped band 38 having pair of side members 39 and closed end 41. Rather, U-shaped band 38 could be replaced by alternative devices, such as simply a pair of spaced apart side members, without departing from the spirit of the present invention.

Figure 2:
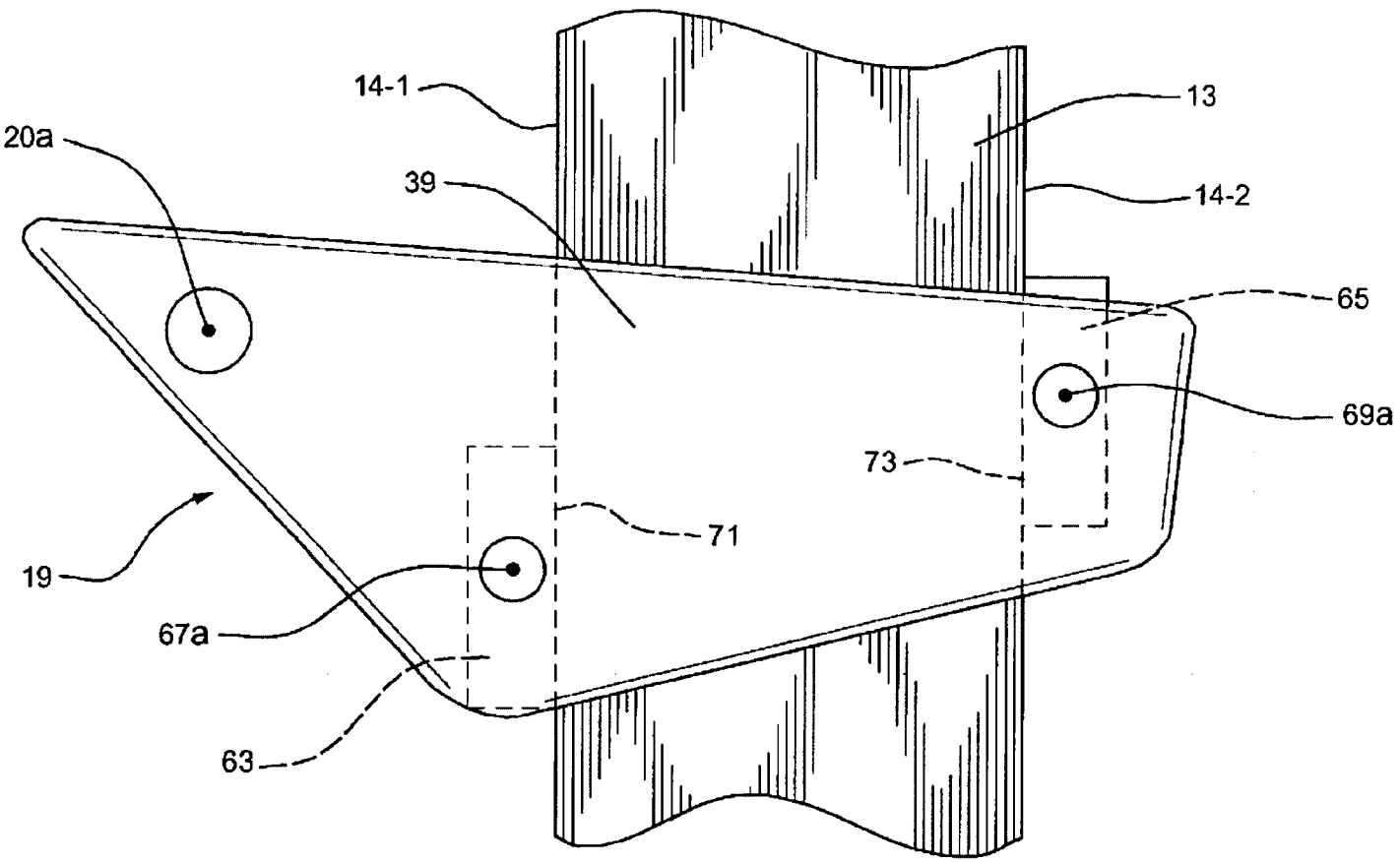
FIG. 2 is an enlarged side view of the load activated lock shown in FIG. 1*a*, the lock being shown in a clamped position on an upright of width slightly wider than the design width, the inner and outer jaws being shown in phantom.

Side members 39 of U-shaped band 38 are shaped to include a first pair of openings 47 and a second pair of openings 49, first pair of openings 47 being disposed beneath the plane defined by fulcrum pivot axis 20*a* and second pair of openings 49. As shown in FIG. 2, first and second pairs of openings 47 and 49 are shaped to allow for the insertion of a device, such as a pivot rod, therethrough.

It should be noted that lock 19 is not limited to the particular size and shape of side members 39. Rather, side members 39 could be replaced with different sized and shaped side members which are shaped to include openings which differ in size and shape from openings 47 and 49 without departing from the spirit of the present invention.

Load activated lock 19 further comprises an inner jaw 63 and an outer jaw 65 which together engage opposing sides of upright 13 to securely mount bracket assembly 11 thereon. It should be noted that the particular shape and construction of inner jaw 63 and outer jaw 65, which may differ from each other, create numerous functional advantages and accordingly serve as principal features of the present invention.

Figure 6:
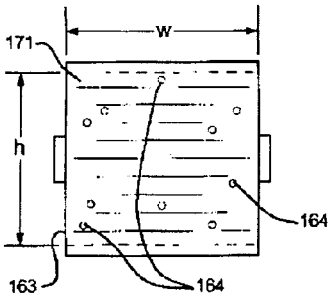
FIG. 6 is a rear plan view of the rippled inner jaw shown in FIG. 5, the contact surface of the inner jaw being shown with a plurality of random points of contact between the inner jaw and the upright, each of the random points of contact being represented as a circle.
Figure 7:
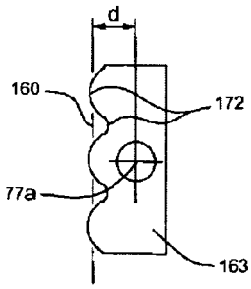
FIG. 7 is a side view of the rippled inner jaw shown in FIG. 5.

In particular, as will be described further in detail below, inner jaw 63 and outer jaw 65 function as planar jaws. A planar jaw, as described herein, is distinguished from prior art edged jaws in that a planar jaw not only is capable of pivoting within its associated lock but also, when pressed firmly against an aluminum upright, contacts the upright over a planar region. A planar region, for the purpose of this application, refers to a region of the upright which is greater than a single line of contact. This is illustrated in FIGS. 6 and 7, where points of contact lie inside a rectangle of width, w, and height, h.

Accordingly, the planar jaws of the present invention may be used in conjunction with an upright having various types of contact surfaces. For example, the contact surface of the upright may be a flat aluminum surface. As another example, the contact surface may be a hardened rippled surface. In fact, the contact surface of the upright may be of any durable surface with regular irregularities. As such, the planar jaw, pivotally mounted in the lock which, in turn, is independently pivotally connected to the angle bracket, will contact the surface of the upright at a plurality of points both horizontally and vertically along the upright. It should be noted that, to permit this extended contact between the jaws and the upright, it is essential that the planar jaws pivot freely with respect to the load supporting angle bracket.

Inner jaw 63 is mounted onto a bar 67 which, in turn, is disposed through openings 47 in side member 39. As can be appreciated, bar 67 is sized and shaped to fit within openings 47 in such a manner so as to enable inner jaw 63 to be capable of pivotal movement about inner jaw pivot axis 67*a* relative to member 39. Similarly, outer jaw 65 is pivotally mounted on a bar 69 which, in turn, is fixedly disposed through openings 49 in side member 39. As can be appreciated, bar 69 is sized and shaped to fit within openings 49 in such a manner so as to enable outer jaw 65 to be capable of pivotal movement about outer jaw pivot axis 69*a* relative to side member 39.

Figure 1B:
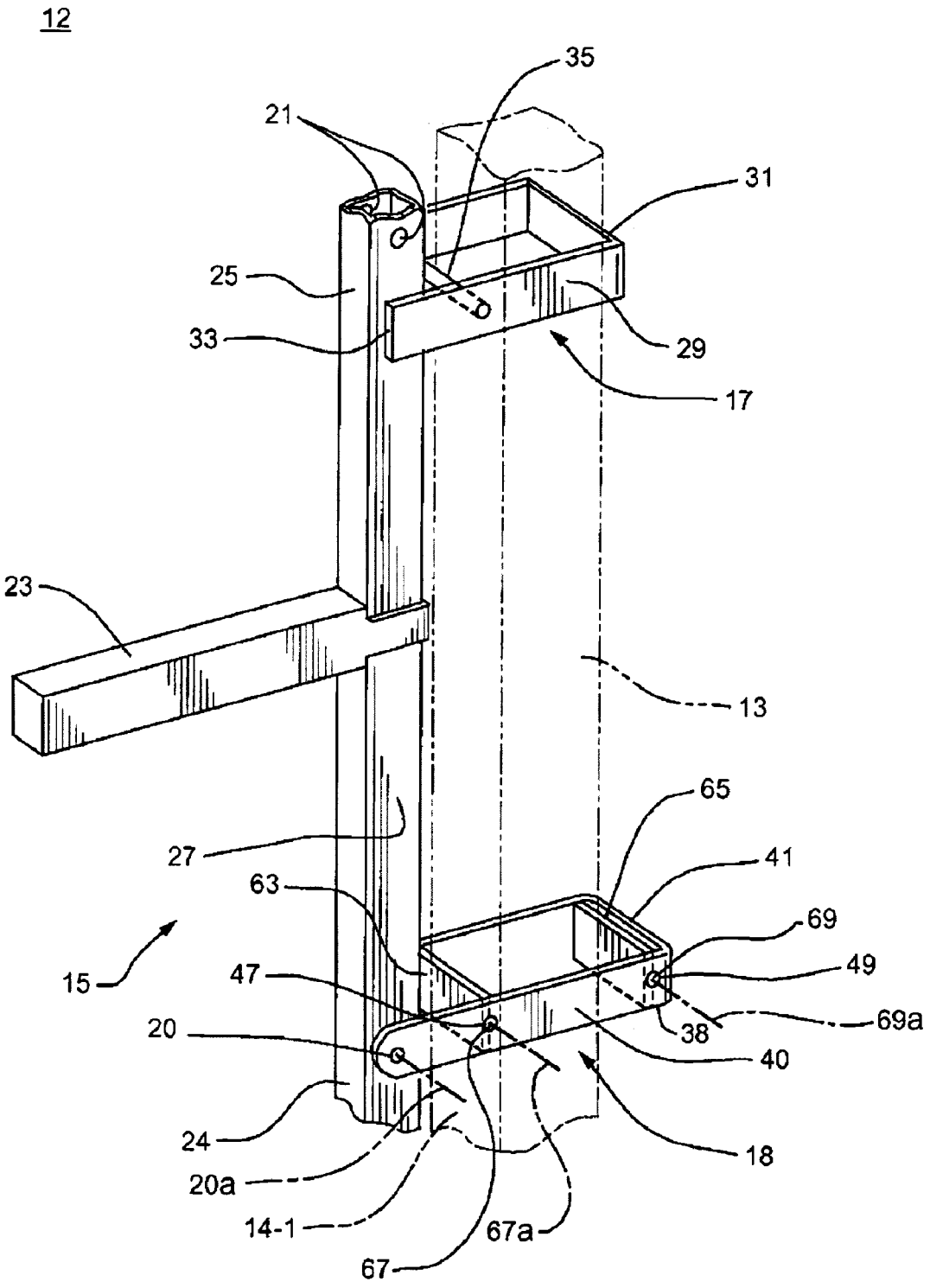
FIG. 1*b* is a perspective view of an alternate embodiment of a bracket assembly constructed according to the teachings of the present invention, the bracket assembly being shown mounted on a vertical upright of design width shown in phantom.

Because the principle feature of the present invention pertains to lock 19, and more particularly, to inner jaw 63 and outer jaw 65, it is to be understood that bracket assembly 11 could be modified without departing from the spirit of the present invention. For example, referring now to FIG. 1*b*, there is shown a bracket assembly constructed according to the teachings of the present invention, the bracket assembly being identified by reference numeral 12.

Bracket assembly 12 differs from bracket assembly 11 in two principal ways. First, bracket assembly 12 includes a bracket arm 17 which is mounted onto upper end 25 of upright 13, rather than lower end 24 of upright 13 as in bracket assembly 11, and bracket assembly 12 includes a lock 18 which is mounted onto lower end 24 of upright 13, rather than upper end 25 of upright 13 as in bracket assembly 11. Second, lock 18 of bracket assembly 12 differs in construction from lock 19 of bracket assembly 11. Specifically, lock 18 includes a pair of spaced apart side members 40 which are shaped so that fulcrum pivot axis 20*a* of fulcrum bar 20 lies within the plane defined by apertures 47 and 49. It should be noted that disposing fulcrum pivot axis 20*a* within the same plane as apertures 47 and 49 renders lock 18 a load actuated lock and not a load activated lock. As a result, a vertical load placed upon horizontal leg 23 of angle bracket 15 creates an inward force on inner jaw 63 of lock 18 which can cause outer jaw pivot axis 69*a* to fall below fulcrum axis 20*a* even on an upright of design width, thereby creating a very dangerous situation. As can be appreciated, this dangerous situation can be avoided by providing a mechanical stop (not shown) so that outer jaw pivot axis 69*a* is maintained above fulcrum pivot axis 20*a* or by placing inner jaw pivot axis 67*a* above the plane defined by fulcrum pivot axis 20*a* and outer jaw pivot axis 69*a*.

Bracket assembly 110 differs from bracket assembly 12 in that identical upper and lower bracket arms 17 capture upright 13 and balance the torque created by placing a load on horizontal arm 23. Bracket assembly 110 comprises a lock 118 which differs from lock 18 of bracket assembly 18 in the location of fulcrum bar 20. Specifically, fulcrum bar 20 of lock 118 connects free ends 46 of side members 40 with links 50, fulcrum bar 20 being disposed through an opening (not shown) formed in one end of each of links 50. Links 50, in turn, are coupled to angle bracket 15 at a point below cross leg 23 by generally cylindrical rod 53. Specifically, rod 53 provides a fixed pivoting axis about which links 50 are free to rotate relative to angle bracket 15. The pivoting of side members 40 of lock 118 with respect to links 50 enables side members 40 to pivot with respect to angle bracket 15. However, it should be noted that the pivot axis about which side members 40 pivot with respect to angle bracket 15 is not in a fixed location relative to angle bracket 15. As can be appreciated, the pivoting of links 50 relative to angle bracket 15 is required to ensure that both jaws 63 and 65 of lock 118 contact inner and outer walls 14-1 and 14-2 of upright 13. As is similarly true for locks 18 and 19, the ability of lock 118 to include side members 40 which pivot with respect to angle bracket 15 as well as to jaws 63 and 65 independently, allows inner jaw 63 to pivot with respect to angle bracket 15 even in the extreme condition in which inner jaw pivot axis 67*a* coincides with fulcrum pivot axis 20*a*. It should be noted that the precise configuration of rod 53 is not a principle object of the present invention and, accordingly, could be of various forms without departing from the spirit of the present invention.

Figure 3:
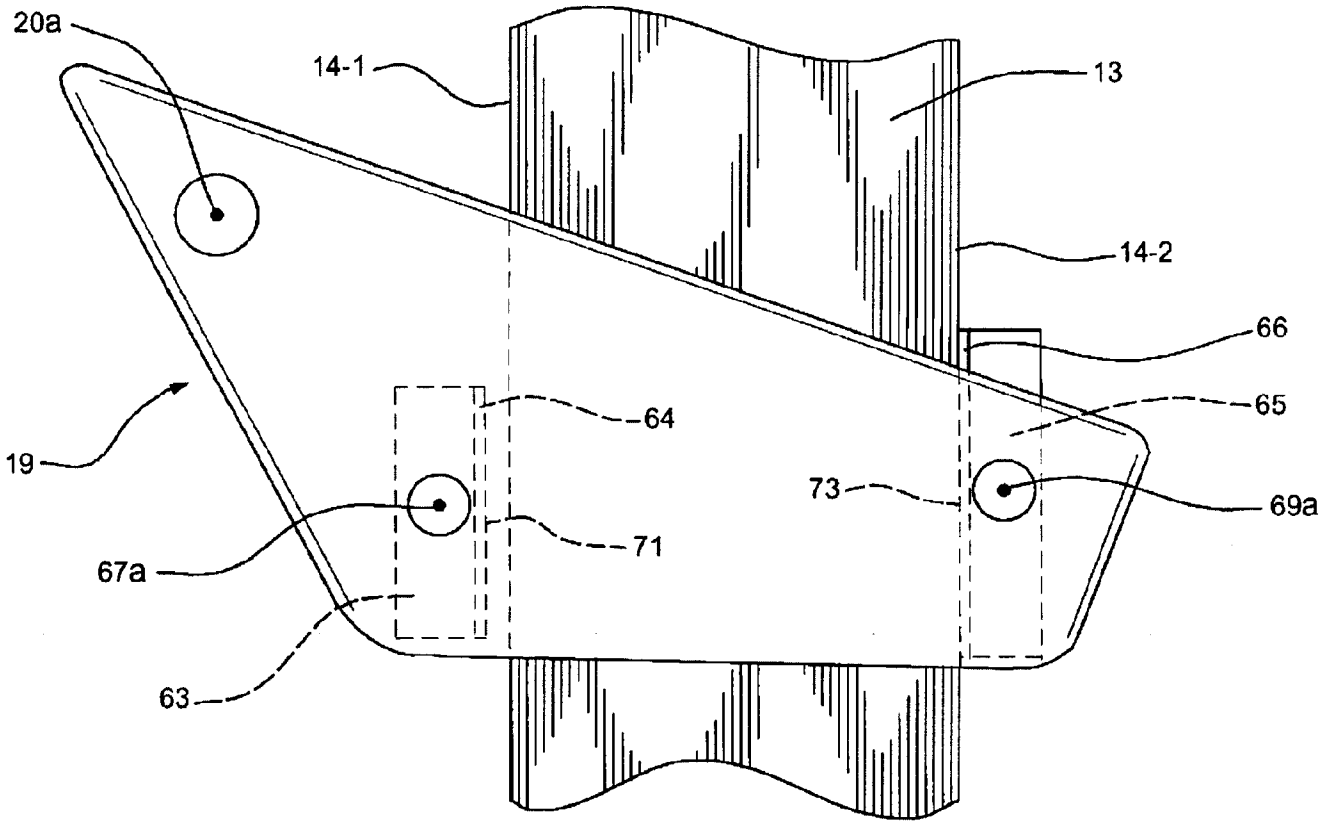
FIG. 3 is an enlarged side view of the load activated lock shown in FIG. 2, the lock being shown rotated in the clockwise direction so that the lock is disposed in an unclamped position on the upright, the inner and outer jaws being shown in phantom.

Referring now to FIGS. 2 and 3, outer jaw 65 is an elongated member which is generally rectangular in both longitudinal and lateral cross-section. Outer jaw 65 comprises a flat contact surface 73 which contacts outer surface 14-2 of upright 13 over a planar region during use. Similarly, inner jaw 63 comprises a flat contact surface 71 which contacts inner surface 14-1 of upright 13 over a planar region during use.

Since inner jaw 63 and outer jaw 65 are permitted to pivot with respect to angle bracket 15, when lock 19 is loaded onto upright 13, inner jaw 63 and outer jaw 65 contact flat inner surface 14-1 and flat outer surface 14-2, respectively, of upright 13 over an extended planar area. Thus, the horizontal forces which jaws 63 and 65 exert onto upright 13 to prevent bracket assembly 11 from slipping on upright 13 are distributed over an extended planar region of upright 13, thereby preventing damage to upright 13, which is a principal object of the present invention. As can be appreciated, the edged jaws of prior art locks would contact a metal or plastic upright along a linear region and not along a planar region as in lock 19.

Outer jaw 65 also comprises a longitudinal hole (not shown) running throughout its length through which bar 69 may be slidably disposed for mounting outer jaw 65 on load activated lock 19. It should be noted that the present invention is not limited to bar 69 being slidably disposed within outer jaw 65. Rather, in an alternative, bar 69 could be integrally formed onto outer jaw 65 and could be disposed to rotate within openings 49 without departing from the spirit of the present invention. Similar arrangements also hold for inner jaw 63.

FIG. 2 shows a side view of load activated lock 19 mounted on upright 13. It should be noted that load activated lock 19 is dimensioned so that outer jaw pivot axis 69*a* lies below a horizontal plane passing through fulcrum pivot axis 20*a*. In addition, load activated lock 19 is dimensioned so that inner jaw pivot axis 67*a* lies below the plane defined by fulcrum pivot axis 20*a* and outer jaw pivot axis 69*a*.

As shown in FIG. 3, when load activated lock 19 is rotated clockwise, the horizontal distance between inner jaw pivot axis 67*a* and outer jaw pivot axis 69*a* increases. As a result, as load activated lock 19 is rotated clockwise, contact surface 71 of inner jaw 63 will no longer abut against inner surface 14-1 of upright 13 since, when angle bracket 11 is loaded, contact surface 73 of outer jaw 65 abuts against outer surface 14-2 of upright 13. In fact, through the use of a spring mechanism (not shown), or other similar device, which biases inner jaw 63 in a substantially 90 degree orientation, planar surface 71 of inner jaw 63 is parallel with and spaced apart from inner surface 14-1 of upright 13.

It should be noted that, as shown in FIG. 3, the contacting materials 64 and 66 of inner and outer jaws 63 and 65, respectively, may differ from those of the other parts of inner and outer jaws 63 and 65.

In use, as bracket assembly 11 is raised or lowered, the vertical force provided by the load on horizontal leg 23 is transferred to a block and tackle or other lifting device which is coupled to apertures 21.

When bracket assembly 11 is being raised by block and tackle or other means, the frictional forces between contact surface 71 of inner jaw 63 and upright 13 as well as the frictional forces between contact surface 73 of outer jaw 65 and upright 13 generate a downward vertical force on outer jaw 65 which, in turn, rotates load activated lock 19 in a clockwise direction so that contact surface 71 of inner jaw 63 no longer grips upright 13. In the case that inner jaw 63 or outer jaw 65 encounter a positive stop on either inner surface 14-1 or outer surface 14-2 on upright 13, the clockwise rotation of load activated lock 19 continues until inner jaw 63 no longer contacts upright 13, as shown in FIG. 3.

When bracket assembly 11 is being lowered, the force required to rotate load activated lock 19 in a clockwise direction is provided by pulling down or pressing on outer jaw 65, such as by a rope or foot pedal. In either case, when bracket assembly 11 is raised or lowered, load activated lock 19 is subjected to forces which rotate it in a clockwise direction and greatly reduce or eliminate the frictional forces between inner jaw 63 and upright 13.

When bracket assembly 11 is being lowered, the force required to rotate lock 19 in a clockwise direction is provided by pressing on closed end 41, such as by foot or by foot pedal, thereby creating an open space between outer surface 14-2 and outer jaw 65. When bracket assembly 11 is being raised by a jack, the clockwise rotation of lock 18 increases the space between inner jaw 63 and outer jaw 65, thereby enabling outer jaw 65 to pass over a stop on outer surface 14-2 of upright 13 if the stop is tapered and small enough.

This invention is concerned with the design of inner and outer jaws 63 and 65 for use on uprights 13 constructed of materials, such as metal or plastic, which may have lower coefficients of friction and better dimensional stability than wooden uprights.

Figure 4:
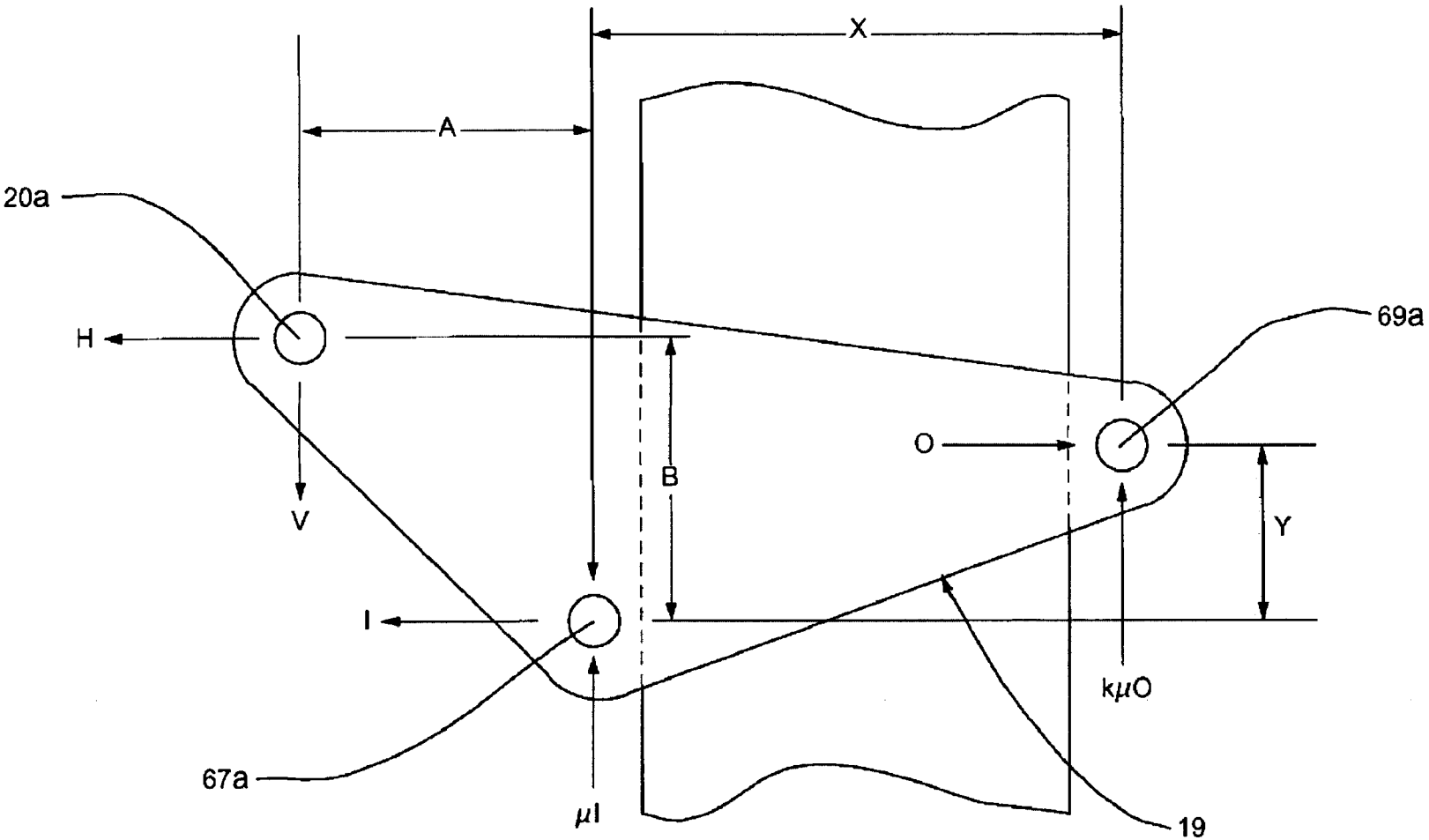
FIG. 4 is an enlarged side view of the load activated lock shown in FIG. 2, the lock showing the forces acting on the side members of said lock resulting from a vertical load placed on the angle bracket.

FIG. 4 shows the horizontal force H and the vertical force V acting on fulcrum pivot axis 20*a* of load activated lock 19. The inwardly directed, horizontal force applied onto inner jaw pivot axis 67*a* is denoted by arrow I and the upwardly directed, frictional force applied onto inner jaw pivot axis 67*a* is denoted by arrow μI. The outwardly directed, horizontal force applied onto outer jaw pivot axis 69*a* is denoted by arrow O and the upwardly directed, frictional force applied onto outer jaw pivot axis 69*a* is denoted by kμO, wherein μ represents the minimum coefficient of friction between jaws 63 and 65 and upright 13 which will prevent slipping of lock 19 and k represents a variable introduced to permit different coefficients of friction on opposing sides of upright 13. Distances A and B represent the horizontal and vertical distances, respectively, between fulcrum pivot axis 20*a* and inner jaw pivot axis 67*a*. Distances X and Y represent the horizontal and vertical distances, respectively, between the outer jaw pivot axis 69*a* and the inner jaw pivot axis 67*a*.

Accordingly, the horizontal forces represented by arrows I and O and the minimum value of μ can be found from the following equations, given the values of H, V and k:

$O=I+H$; because the horizontal forces must add to zero — Equation 1

$\mu*(k*O+I)=V$; because the vertical forces must add to zero — Equation 2

$O*Y=k*\mu*O*X+V*A-H*B)/(k*O*X)$; because the torque forces about I must add to zero. — Equation 3

As a result, using the equations above:

$\mu=V/(k*O+I)=(O*Y-V*A-H*B)/(k*O*X)$ — Equation 4 or $V*k*O*X=((1+k)*O-H)*(O*Y-V*A-H*B)$ — Equation 5

Given the values of V, H, A, B, X, Y and k, quadratic equation 5 can be solved for O. The values of I can be determined from equation 1 and the minimum value, μ, of the coefficient of friction that will prevent slipping can be determined from equation 2.

In an experimental model, built to confirm these calculations, X=4.0, Y=1.15, A=1.65 and B=1.15. In addition, for V=100, H=50, and k=1, O=379.65, I=329.65 and μ=0.141. As can be appreciated, a bracket assembly with a load activated lock having flat, stainless steel, planar jaws can be used on aluminum uprights with a safety factor approximating 2, since the coefficient of friction of stainless steel on aluminum has a value of approximately 0.3. The need for the planar jaws to minimize the damage to the upright is clear from the fact that a 500 lb vertical load placed on the horizontal leg of the bracket assembly at a location so that H=1.5 will result in an inward force onto the outer wall of the upright which exceeds one ton. As can be appreciated, subjected to this large inward force, the edged jaws of prior art locks will significantly damage an aluminum or fiberglass upright. In addition, it should be observed that the minimum coefficient of friction required to prevent slipping of the jaws increases as the distance Y decreases. Thus, the use of load activated lock 19 not only assures that the vertical load will clamp lock 19 onto aluminum upright 13 but also provides greater clamping forces than a lock in which the three pivot axes lie within a single plane, as in lock 18.

FIGS. 5–11 show a modification of upright 13 and load activated lock 19. Specifically, FIGS. 5–11 show a load activated lock 119 which is to be used in conjunction with an upright 113.

Load activated lock 119 differs from load activated lock 19 in that load activated lock 119 includes an inner jaw 163 and an outer jaw 165 which differ in construction from inner jaw 63 and outer jaw 65 of lock 19. Specifically, inner jaw 163 includes a contact surface 171 which includes a plurality of surface irregularities in the form of ripples which are adapted to engage upright 113 over an extended planar region. Outer jaw 165 comprises a pair of spaced apart rollers 173 which are supported in a frame 174, which in turn, is pivotally connected to side members 39 of lock 119. As can be appreciated, inner jaw 163 and outer jaw 165 both function as planar jaws which engage upright 113 over an extended area.

Figure 5:
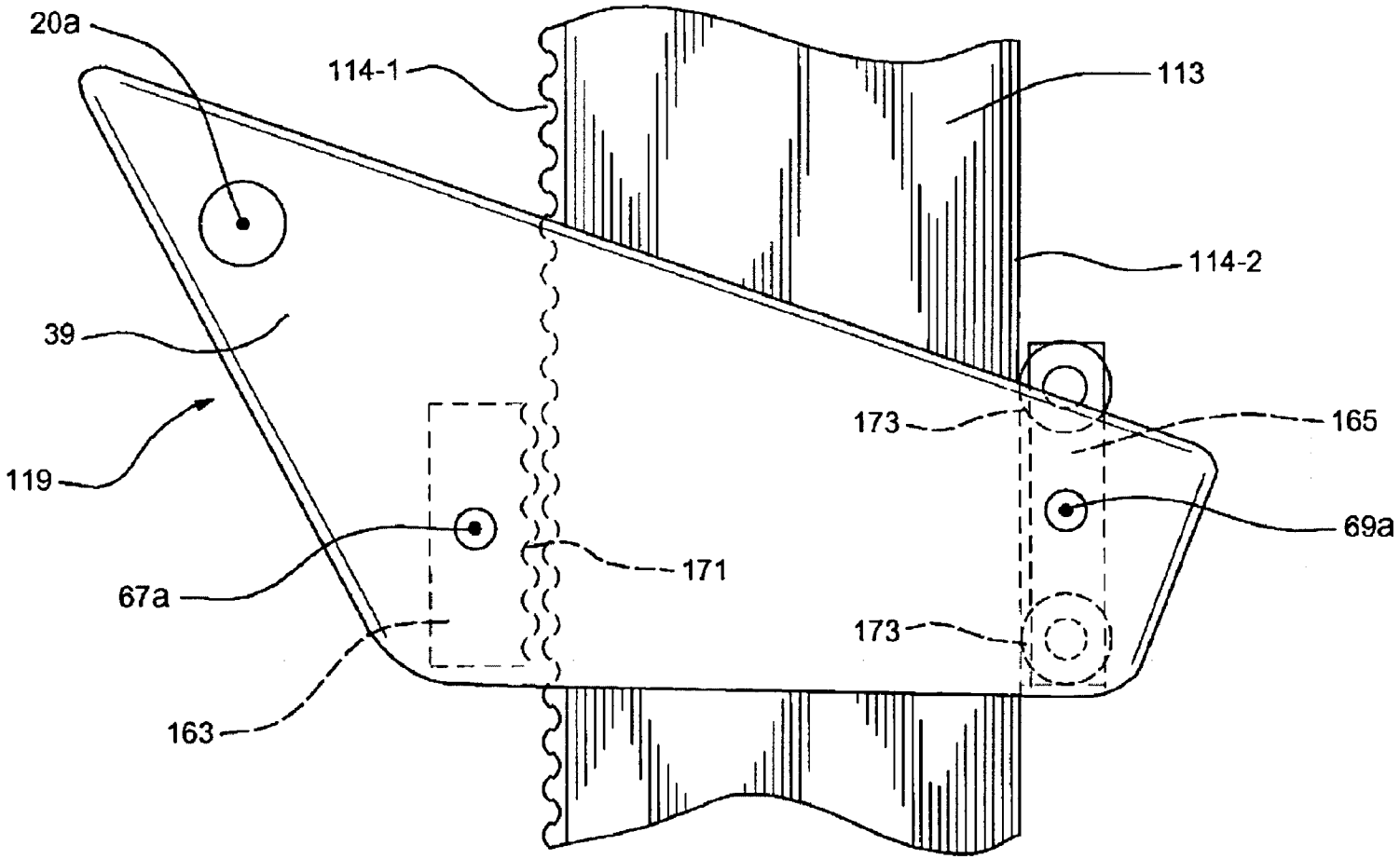
FIG. 5 is an enlarged side view of an alternate embodiment of the load activated lock shown in FIG. 1*a*, the lock being shown in an unclamped position on an upright, the inner and outer jaws being shown in phantom.

Upright 113 is preferably used in combination with inner and outer planar jaws 163 and 165 to increase the friction between upright 113 and inner jaw 163 without materially effecting the ability to raise and lower bracket assembly 11. As shown in FIG. 5, upright 113 comprises recurrent surface irregularities (for example, ripples) on inner surface 114-1 which are sized and shaped to engage with matching surface irregularities (for example, ripples) formed on contact surface 171 of inner jaw 163. As can be appreciated, this arrangement of matching surface irregularities on inner surface 114-1 of upright 113 and contact surface 171 of inner jaw 163 creates a high coefficient of friction between the two surfaces, which is highly desirable.

Referring back to equations 1–5, it should be noted that, when the coefficient of friction between inner surface 173 of outer jaw 165 and outer surface 114-2 of upright is zero (k=0), O has a value of 193.5, I has a value of 143.5 and μ has a value of 0.697. As such, this design provides minimal horizontal forces on upright 113 but requires a high coefficient of friction between inner jaw 163 and upright 113. This high coefficient of friction can be realized by the irregularities of contact surface 171 of inner jaw 163 when contact surface 171 interlock with the matching irregularities formed on inner surface 114-1 of upright 113, as shown in FIG. 5. Rollers 175, rotatably disposed within outer jaw 165 provide the desired low coefficient of friction required along outer surface 114-2 of upright 113. It should be noted that additional rollers 175 could be implemented in outer jaw 165 and that rollers 175 could be made of rubber or any other suitable material. Moreover, the irregularities of contact surface 171 of inner jaw 163 could be supplied by rollers (not shown) mounted in a frame (not shown) as rollers 175 are mounted in outer jaw 165.

Figure 1C:
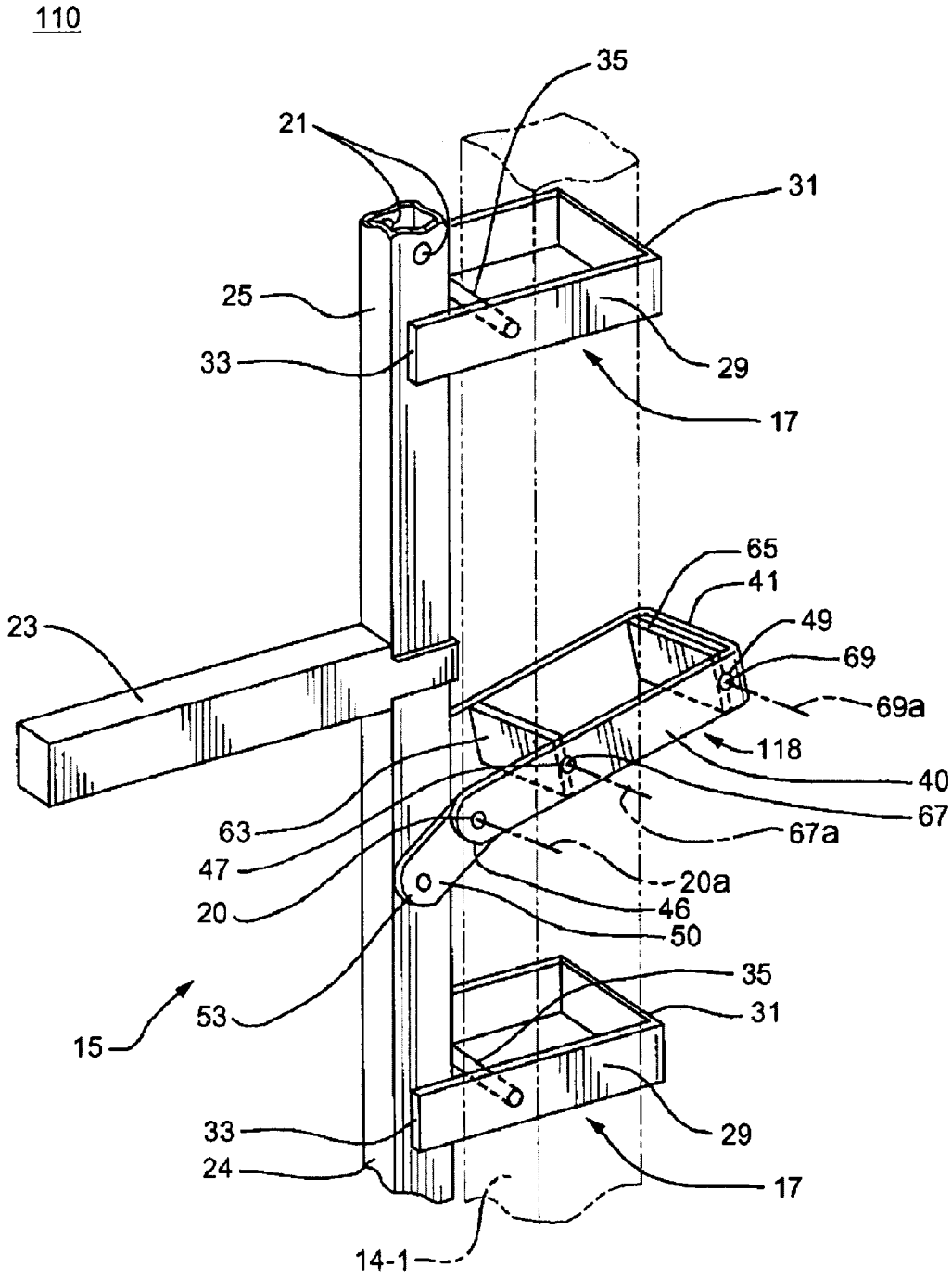
FIG. 1*c* is a perspective view of another alternate embodiment of a bracket assembly constructed according to the teachings of the present invention, the bracket assembly being shown mounted on a vertical upright shown in phantom.

Similar results can be obtained with spring activated lock 118 shown in FIG. 1(*c*) by interchanging the contact surfaces of inner and outer jaws 63 and 65 as well as the contact surfaces of inner and outer surfaces 14-1 and 14-2, respectively. This is possible because the space between outer jaw 65 and outer surface 14-2 increases significantly as angle bracket 15 is raised and lowered.

FIG. 6 is a rear view of inner planar jaw 163 showing contact surface 171, planar jaw 163 being shown with a plurality of random points of contact 164 disposed thereon. Points of contact 164 represent random points of contact surface 171 which contact inner surface 114-1 of upright 113. Specifically, since neither contact surface 171 nor inner surface 114-1 is a machined surface, the precise location of the actual points of contact therebetween will be random. To obtain optimal contact between contact surface 171 and inner surface 114-1, it is essential that inner jaw 163 pivot with respect to angle bracket 15.

FIG. 7 is an end view of planar jaw 163 showing contact points 172 on contact surface 171. Mesial plane 160 is drawn so that contact points 164 of contact surface 171 are equidistant, on either side, therefrom. Of course, a flat jaw contacting a flat upright also defines a mesial plane closely approximating the contacting surface. Distance d is the distance from mesial plane 160 to inner jaw pivot axis 77*a*. Height h, as shown in FIG. 6, is the height of the minimum rectangle, plotted on mesial plane 160, onto which all contact points 164 project. Clearly height h is greater than distance d for a planar jaw.

Figure 8:
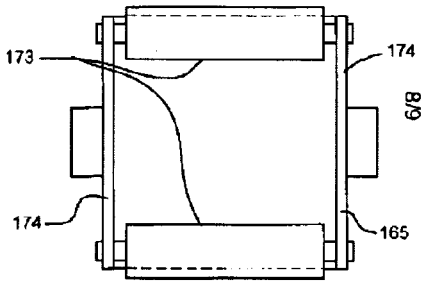
FIG. 8 is a rear plan view of the outer jaw shown in FIG. 5.

FIG. 8 is a rear end view of planar jaw 165 of FIG. 5 showing two rollers 173 pivotally mounted in frame 174.

Figure 9:
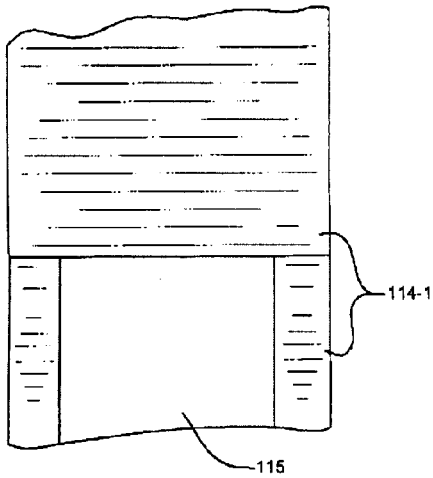
FIG. 9 is a fragmentary, front plan view of a rippled upright.
Figure 10:
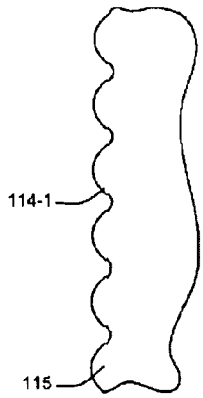
FIG. 10 is a fragmentary, side plan view of the rippled upright shown in FIG. 9.
Figure 11:
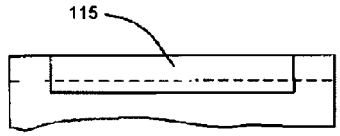
FIG. 11 is a fragmentary, bottom plan view of the rippled upright shown in FIG. 9.

FIGS. 9–11, depict front, side and bottom views of upright 113. It should be noted that the irregularities in front surface 114-1 of upright 113 may be limited in width, such as by incorporating a notch 115 therewithin.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A lock for mounting an angle bracket on an upright, said lock comprising:

(a) a pair of side members, (b) an outer jaw and an inner jaw coupled to said pair of side members, and (c) a fulcrum bar which is adapted to couple said pair of side members to said angle bracket, said pair of side members being capable of pivoting relative to said angle bracket about said fulcrum bar, (d) at least one of said inner jaw and said outer jaw comprising a substantially flat, toothless contact surface which is adapted to contact a substantially planar longitudinal surface of the upright over a planar region, said at least one of said inner jaw and said outer jaw being capable of pivoting relative to said pair of side members and said angle bracket.

2. The lock as claimed in claim 1 wherein said inner jaw is disposed beneath the plane defined by said outer jaw and said fulcrum bar.

3. The lock as claimed in claim 2 wherein a transverse cross-sectional area of said at least one of said inner jaw and said outer jaw is generally rectangular in shape.

4. The lock as claimed in claim 3 wherein said at least one of said inner jaw and said outer jaw is pivotally mounted on a bar which is coupled to said pair of side members.

5. The combination of:

(a) an upright having a plurality of surface irregularities, and (b) a lock for mounting an angle bracket on said upright, said lock comprising:

(i) a pair of side members, (ii) an outer jaw and an inner jaw coupled to said pair of side members, and (iii) a fulcrum bar which is adapted to couple said pair of side members to said angle bracket, said pair of side members being capable of pivoting relative to said angle bracket about said fulcrum bar, (iv) at least one of said inner jaw and said outer jaw comprising a contact surface which includes a plurality of surface irregularities, the plurality of surface irregularities on said at least one of said inner jaw and said outer jaw being sized and shaped to matingly engage with the plurality of surface irregularities on said upright, said at least one of said inner jaw and said outer jaw being capable of pivoting relative to said pair of side members and said angle bracket.

6. The combination as claimed in claim 5 wherein the plurality of surface irregularities on said at least one of said inner jaw and said outer jaw are sized and shaped to matingly engage with the plurality of surface irregularities on said upright over a region greater than a line.

7. The combination as claimed in claim 5 wherein said inner jaw is disposed beneath the plane defined by said outer jaw and said fulcrum bar.

8. The combination as claimed in claim 7 wherein said at least one of said inner jaw and said outer jaw is pivotally mounted on a bar which is coupled to said pair of side members.

9. The combination as claimed in claim 8 wherein the plurality of surface irregularities on the contact surface are in the form of a plurality of ripples.

* * * * *